US007992742B1

(12) United States Patent
Kim

(10) Patent No.: US 7,992,742 B1
(45) Date of Patent: Aug. 9, 2011

(54) REFUSE RECEPTACLE WITH SPRING BIAS ARRANGEMENT

(75) Inventor: Bumkee Kim, Corona, CA (US)

(73) Assignee: Sinclair Worldwide, Inc., Ontario, CA (US)

( * ) Notice: Subject to any disclaimer, the term of this patent is extended or adjusted under 35 U.S.C. 154(b) by 1119 days.

(21) Appl. No.: 11/749,227

(22) Filed: May 16, 2007

(51) Int. Cl.
*B65F 1/06* (2006.01)

(52) U.S. Cl. ..... 220/495.08; 220/908.1; 53/576

(58) Field of Classification Search ..... 220/23.87, 220/908.1, 495.06, 495.08, 495.1, 254.1, 220/254.6; 53/576
See application file for complete search history.

(56) References Cited

U.S. PATENT DOCUMENTS

| | | | | |
|---|---|---|---|---|
| 868,821 | A * | 10/1907 | Stephenson | 220/254.3 |
| 3,452,368 | A | 7/1969 | Couper | |
| 4,577,778 | A | 3/1986 | Kim | |
| 4,753,367 | A | 6/1988 | Miller et al. | |
| 4,776,478 | A | 10/1988 | Miller et al. | |
| 5,628,424 | A | 5/1997 | Gola | |
| 5,655,680 | A | 8/1997 | Asbach et al. | |
| 5,662,238 | A | 9/1997 | Sarno | |
| 5,971,194 | A | 10/1999 | Freedland | |
| 5,984,134 | A | 11/1999 | Mario | |
| 6,170,240 | B1 | 1/2001 | Jacoby et al. | |
| 6,612,099 | B2 * | 9/2003 | Stravitz | 53/526 |
| 7,146,785 | B2 | 12/2006 | Stravitz | |
| 2006/0201434 | A1 * | 9/2006 | Kujawa et al. | 119/61.5 |

* cited by examiner

*Primary Examiner* — Stephen Castellano
(74) *Attorney, Agent, or Firm* — Richard M. Goldberg

(57) ABSTRACT

A refuse receptacle includes an outer enclosure having an upper frame member with an opening through which refuse can be deposited into the outer enclosure, and a cover movably mounted on the upper frame member between a position normally closing the opening and a position which permits refuse to be deposited through the opening into the outer enclosure. A tubular refuse holder is mounted on a spring plate in the outer enclosure, the refuse holder including an upper open end for receiving refuse deposited through the opening. A plurality of coil springs are provided between the spring plate and a ledge in the enclosure to bias the refuse holder toward the upper frame member such that there is engagement of the upper open end of the refuse holder against the upper frame member to provide a seal thereat.

13 Claims, 16 Drawing Sheets

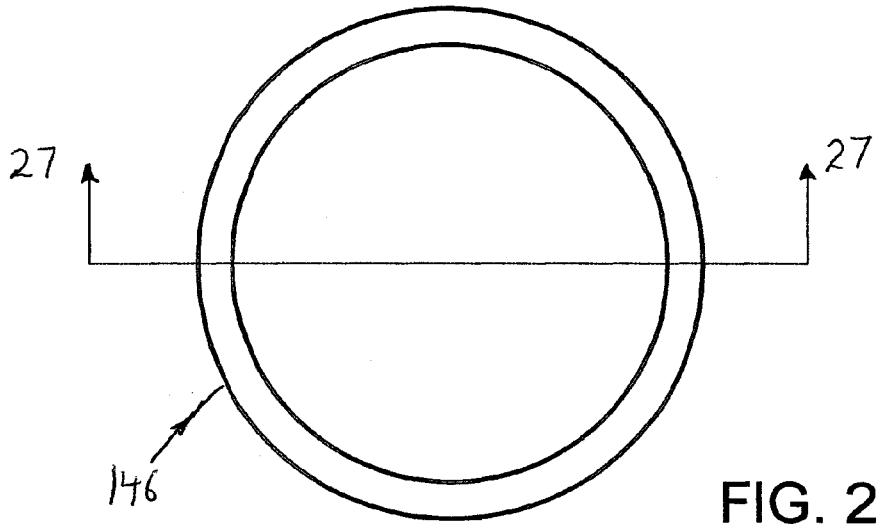
FIG. 26
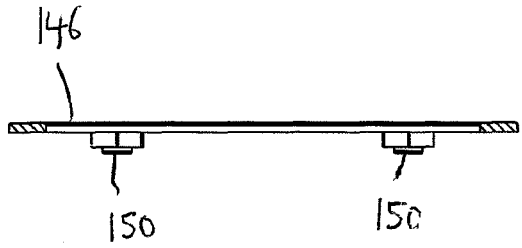
FIG. 27
FIG. 28
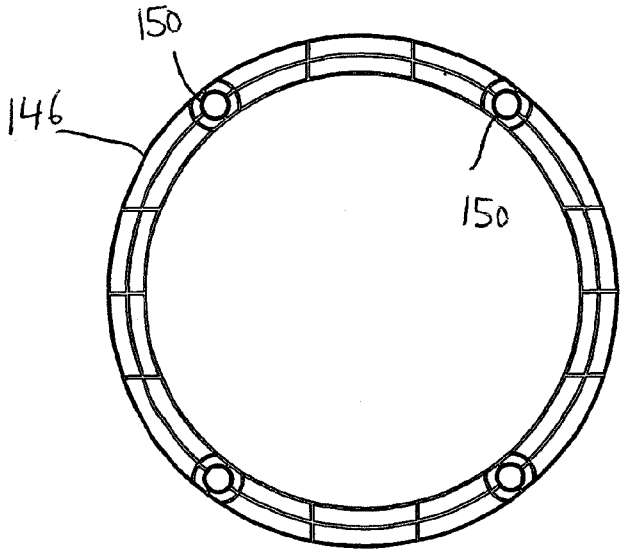

REFUSE RECEPTACLE WITH SPRING BIAS ARRANGEMENT

BACKGROUND OF THE INVENTION

The present invention relates generally to refuse receptacles, and more particularly, is directed to a refuse receptacle of the type having a removable tubular refuse holder.

U.S. Pat. No. 4,577,778 discloses a novel refuse receptacle which uses a continuous bag liner, for example, a tubular bag which is 100 feet long, which is folded over itself many times to provide many folds. This is formed by a continuous elongated vinyl sleeve which is mounted on the outer peripheral surface of a tubular refuse holder that is, in turn, mounted within the receptacle. The bag liner is pulled down from an opening in the bottom of the tubular refuse holder and a knot is tied therein to form the individual garbage bags. This novel refuse receptacle and the operation thereof can be readily seen at the website www.magikan.com.

However, a problem with this refuse receptacle is that there is a gap between the upper end of the tubular refuse holder and the folded vinyl sleeve mounted thereon, on the one hand, and the hinged lid, on the other hand. This means that odors from refuse in the continuous bag liner can escape through this small gap at the upper end and then escape around the outside of the outer surface of tubular refuse holder, that is, to an area between the tubular refuse holder and the outer enclosure of the main body. Because the main body is not airtight, these odors escape into the atmosphere and can be unpleasant.

SUMMARY OF THE INVENTION

Accordingly, it is an object of the present invention to provide a refuse receptacle that overcomes the aforementioned problems.

It is another object of the present invention to provide a refuse receptacle that provides a seal at the upper end of the tubular refuse holder.

It is still another object of the present invention to provide a refuse receptacle in which the upper end of the tubular refuse holder is biased by springs into engagement with the upper ring frame to provide a seal thereat.

It is yet another object of the present invention to provide a refuse receptacle in which odors escaping into the atmosphere from refuse in the tubular refuse holder, are greatly diminished.

In accordance with an aspect of the present invention, a refuse receptacle includes an outer enclosure having an upper frame member with an opening through which refuse can be deposited into the outer enclosure, and a cover movably mounted on the upper frame member between a position normally closing the opening and a position which permits refuse to be deposited through the opening into the outer enclosure. A refuse holder is mounted in the outer enclosure, the refuse holder including an upper open end for receiving refuse deposited through the opening. At least one biasing member provides relative biasing movement between the refuse holder and upper frame member such that there is engagement of the upper open end of the refuse holder against the upper frame member to provide a seal thereat.

The at least one biasing member includes at least one spring which biases the refuse holder toward the upper frame member. Specifically, the outer enclosure includes an inner wall for supporting one end of the at least one spring. A spring plate engages an opposite end of the at least one spring, with the refuse holder mounted on the spring plate. The refuse holder has a tubular shape and a flange which extends outwardly from a lower edge of the tubular refuse holder, with the flange seating on the spring plate. Preferably, there are a plurality of the springs, with each spring being a coil spring.

Preferably, the outer enclosure includes at least one guide on an inner wall thereof for guiding movement of the refuse holder toward the upper frame member without rotation of the refuse holder. In such case, the spring plate includes at least one cut-out section for receiving the at least one guide on the inner wall of the outer enclosure.

There is also an arrangement for releasably engaging the upper frame member to the outer enclosure. Specifically, the upper frame member is pivotally mounted at one end thereof to the outer enclosure and includes a releasable locking arrangement at an opposite end for releasably engaging the outer enclosure. The refuse holder is removably mounted in the outer enclosure, and can be removed from the outer enclosure when the opposite end of the upper frame member is disengaged from the outer enclosure and the upper frame member is pivoted away from the outer enclosure.

Preferably, the refuse holder has a tubular shape and is adapted to hold a continuous sleeve thereon which is folded over itself many times to provide many folds and which is pulled down through an opening in a bottom of the tubular refuse holder such that a knot is adapted to be tied therein to form an individual garbage bag. The outer enclosure further includes a front door through which the continuous sleeve can be cut and removed when filled with refuse.

The above and other features of the invention will become readily apparent from the following detailed description thereof which is to be read in connection with the accompanying drawings.

BRIEF DESCRIPTION OF THE DRAWINGS

FIG. 26 is a top plan view of the annular spring plate;

FIG. 27 is a cross-sectional view of the annular spring plate of FIG. 26, taken along line 27-27 thereof; and FIG. 28 is a bottom plan view of the annular spring plate.

DETAILED DESCRIPTION

Figure 1:
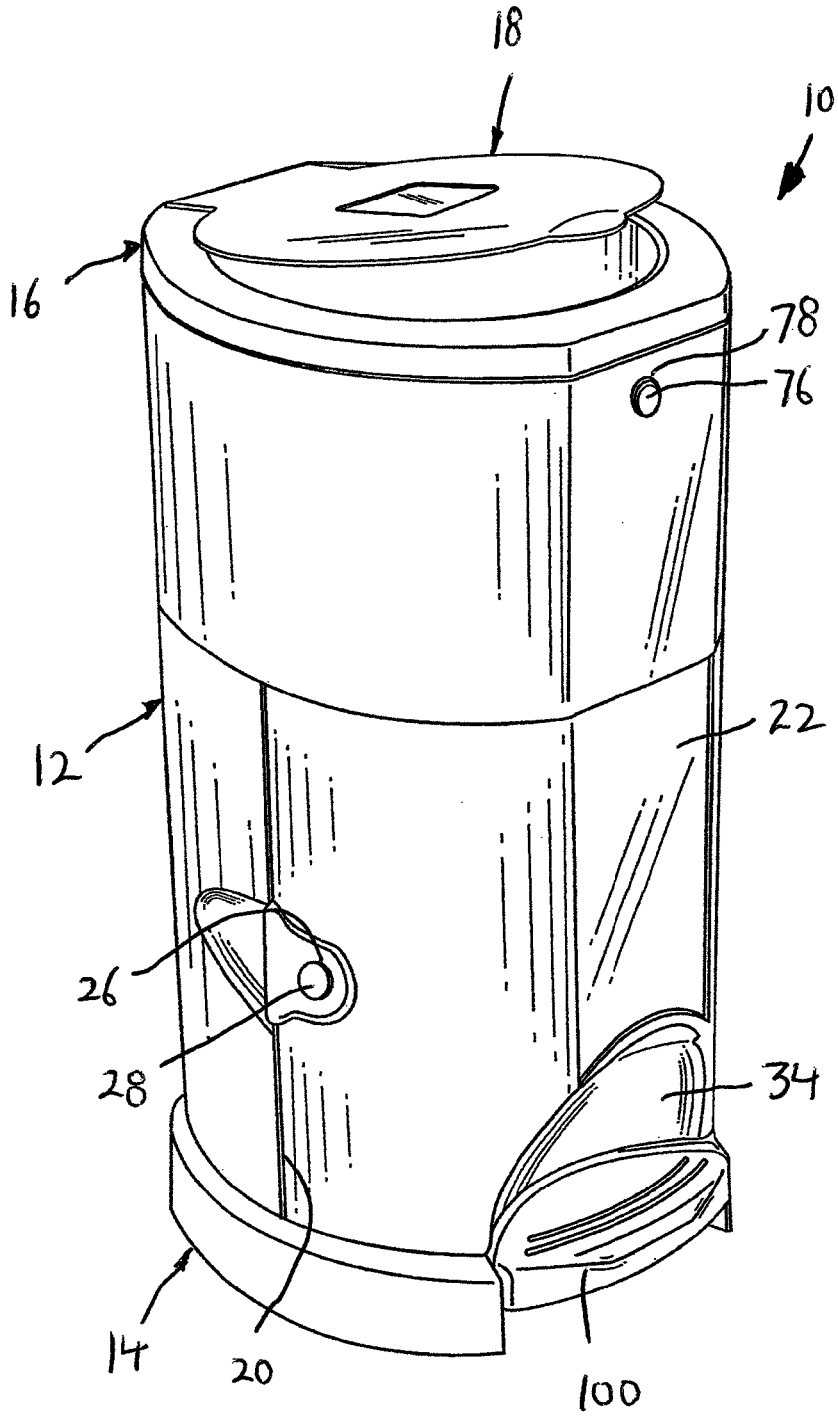
FIG. 1 is a perspective view of a refuse receptacle according to a first embodiment of the present invention, with the upper lid in a partially open position.
Figure 2:
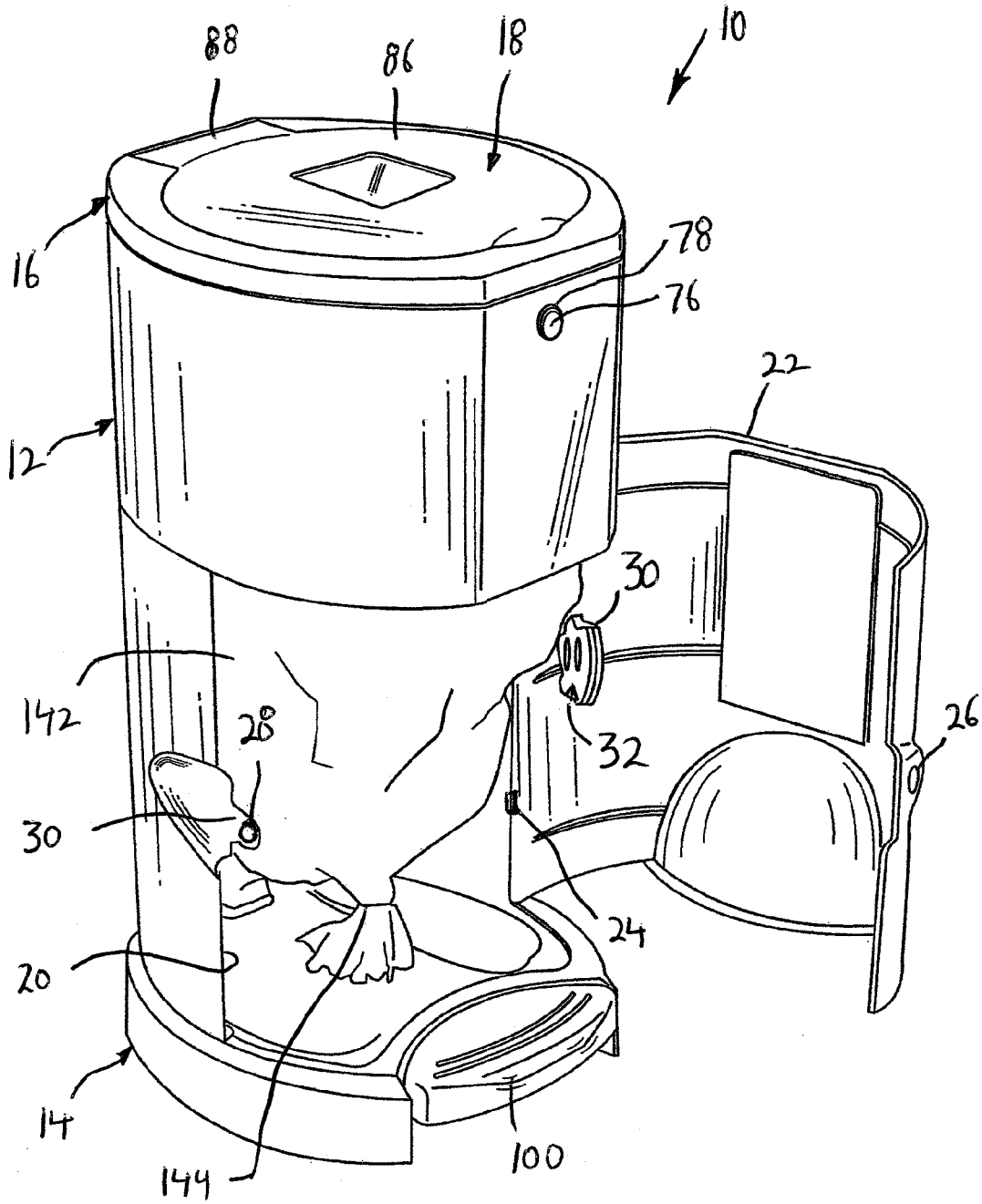
FIG. 2 is a perspective view of the refuse receptacle with the front door in an open position.
Figure 3:
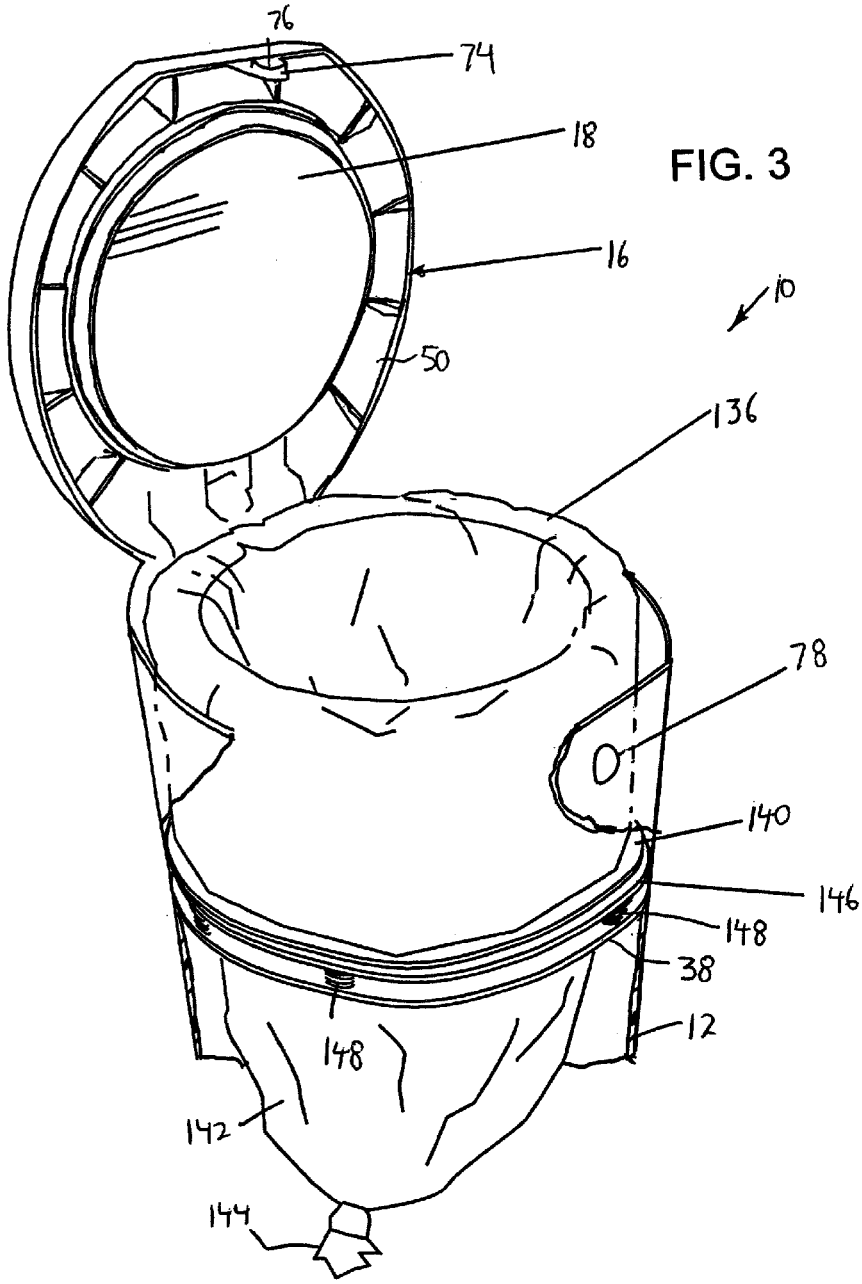
FIG. 3 is a perspective view of an upper portion of the refuse receptacle, partially broken away, with the upper lid fully open.

Referring to the drawings in detail, and initially to FIGS. 1-3 thereof, there is shown a refuse receptacle 10 according to the present invention. Refuse receptacle 10 is preferably of the type disclosed in U.S. Pat. No. 4,577,778, the entire disclosure of which is incorporated herein by reference. Specifically, refuse receptacle 10 includes an outer enclosure 12 mounted on a base 14. An upper ring frame 16 is mounted to the upper end of enclosure 12, with upper ring frame 16 being closed by an upper lid 18.

Outer enclosure 12 is preferably of a general cylindrical shape, although the present invention is not limited to this shape. Outer enclosure 12 includes a front opening 20 which is closed by a front door 22 hinged at one side of opening 20 by hinges 24. The opposite side of front door 22 includes a small opening 26 for receiving a locking button 28 mounted to a slightly flexible and resilient extension 30 which projects from outer enclosure 12 at the opposite side of opening 20. In order to open front door 22, it is merely necessary to push locking button 28 out of small opening 26 and then pivot front door 22 to an open position about hinges 24, as shown in FIG. 2. A knife holder 30 is mounted to the inside of front door 22 and includes a recessed knife 32 therein, the purpose for which will become apparent from the discussion hereafter. In addition, front door 22 includes a lower inwardly directed recessed portion 34 to enable access to a foot pedal mounted to base 14, as will be better understood from the discussion hereafter.

Figure 4:
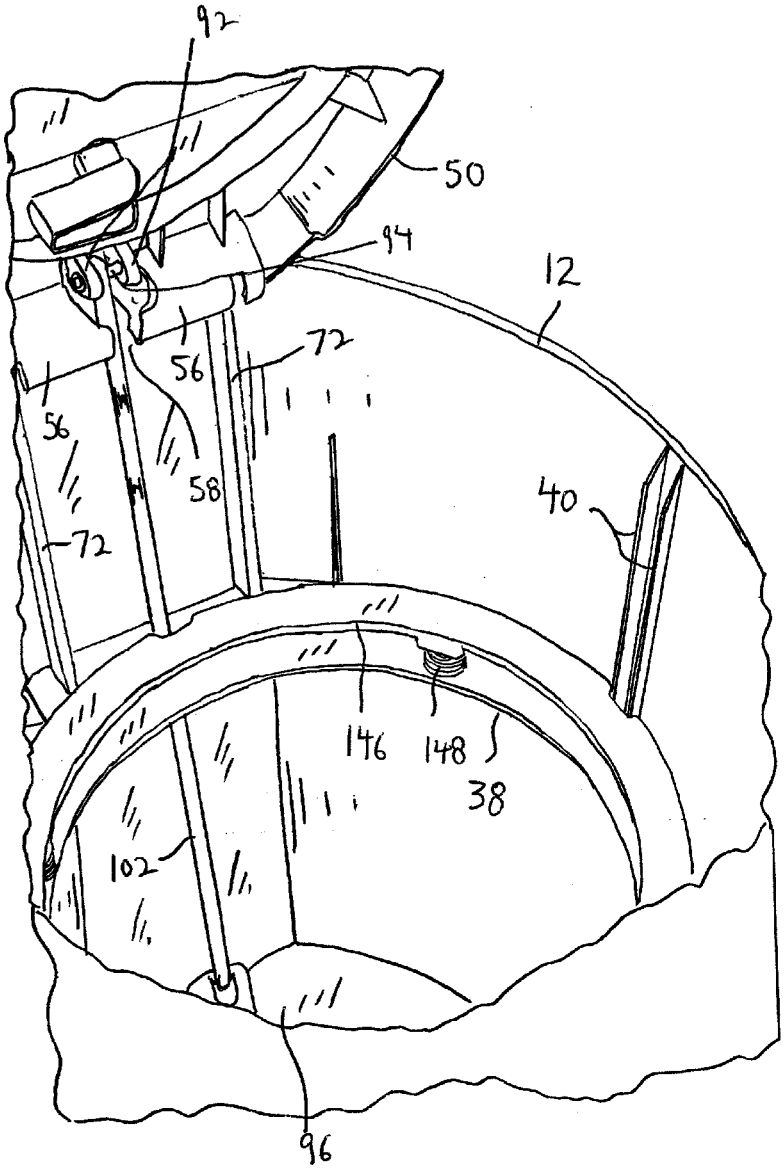
FIG. 4 is an enlarged perspective view of a portion of the inside of the refuse receptacle.
Figure 5:
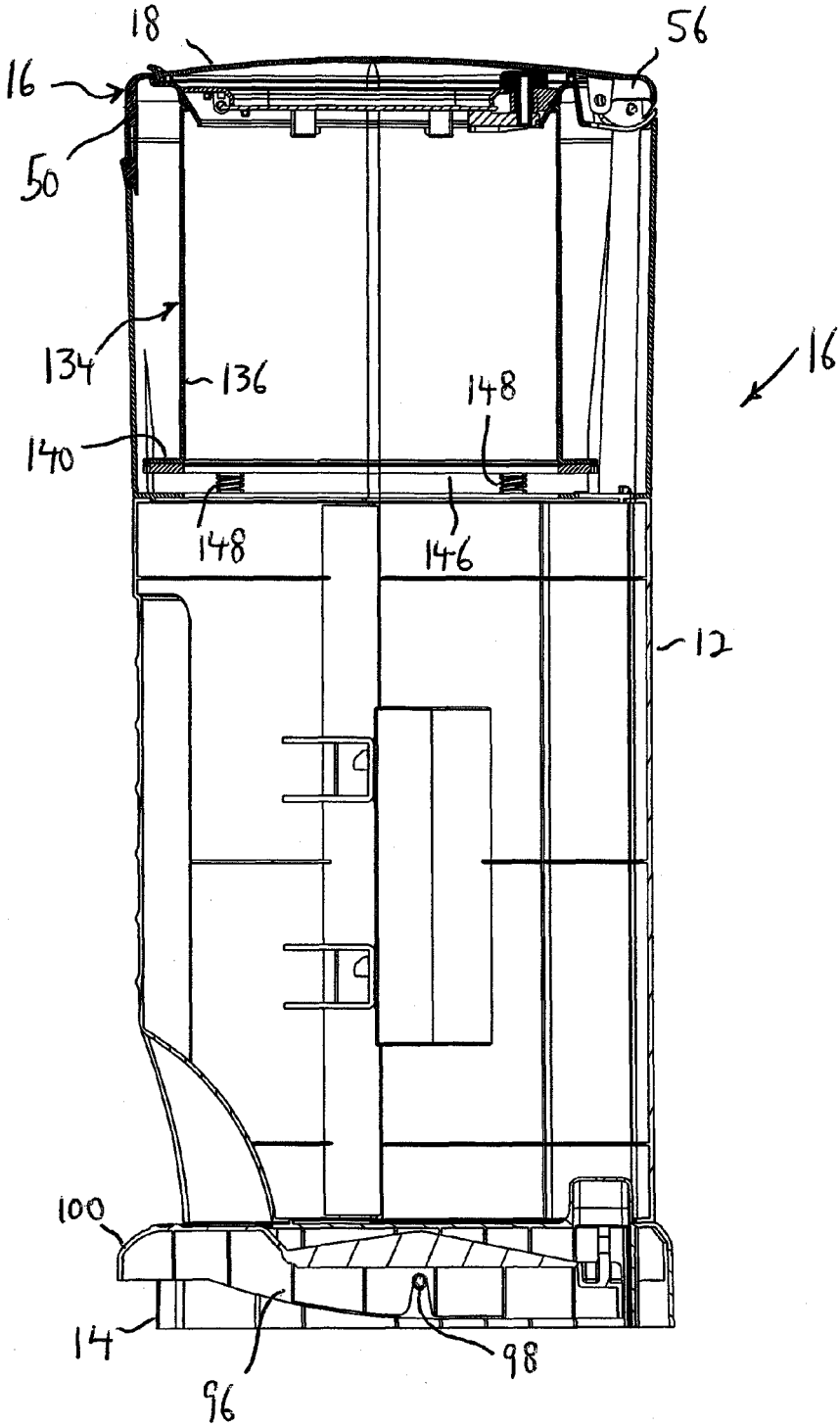
FIG. 5 is a vertical cross-sectional view of the refuse receptacle of FIG. 1, taken along line 5-5 thereof.

As shown best in FIG. 4, an annular ledge 38 is mounted to the inner wall surface of outer enclosure 12 at about mid-height of outer enclosure 12, and a plurality of pairs of vertically oriented guide walls 40 are also preferably mounted along the inner wall surface of outer enclosure 12.

As shown in FIGS. 1-7, upper ring frame 16 is pivotally secured to the upper end of outer enclosure 12. As shown best in FIGS. 5-12, upper ring frame 16 includes a generally annular horizontal upper wall 42. A short substantially annular lip 46 extends upwardly from the outer periphery of upper wall 42, whereby upper wall 42 and lip 46 together define a shallow recess 48. A substantially annular, downwardly extending skirt 50 is connected in parallel, slightly spaced relation to annular lip 46 by a stub wall 52.

Figure 8:
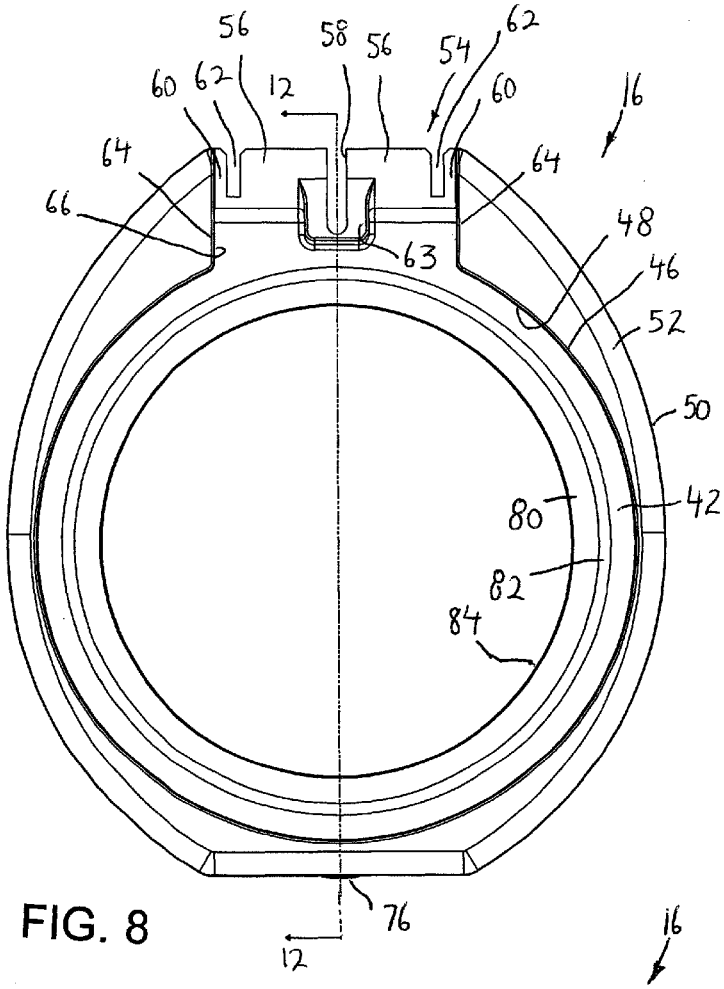
FIG. 8 is a top plan view of the upper ring frame.
Figure 9:
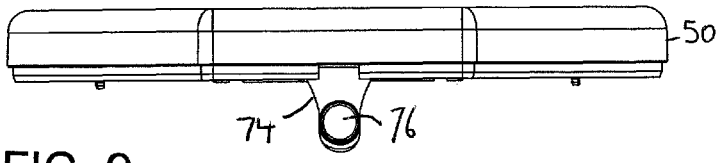
FIG. 9 is a front elevational view of the upper ring frame.
Figure 10:
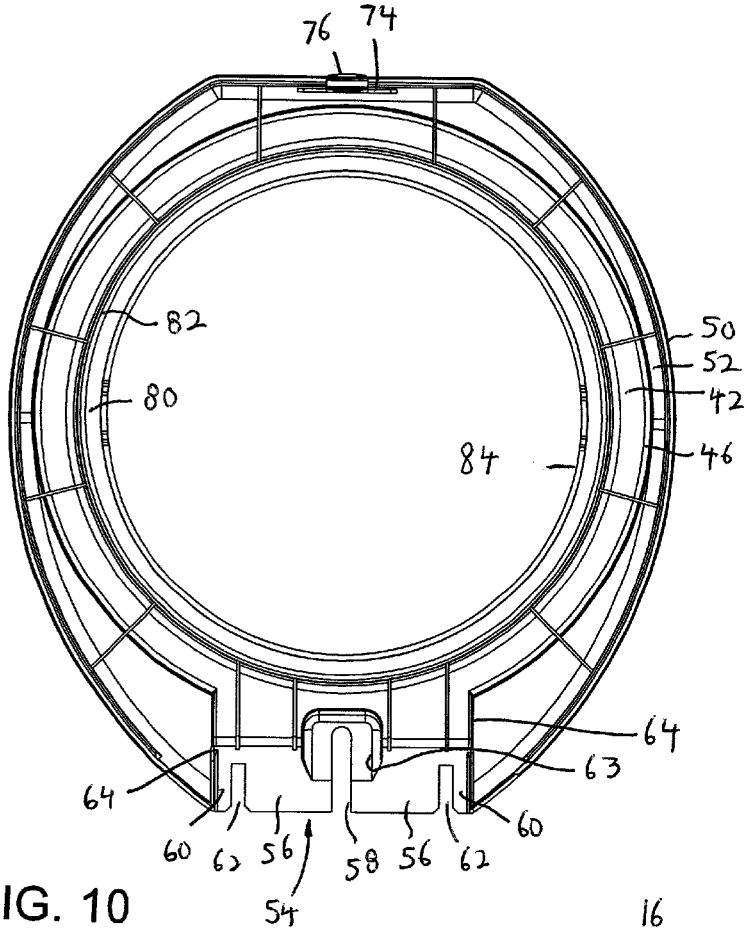
FIG. 10 is a bottom plan view of the upper ring frame.
Figure 11:
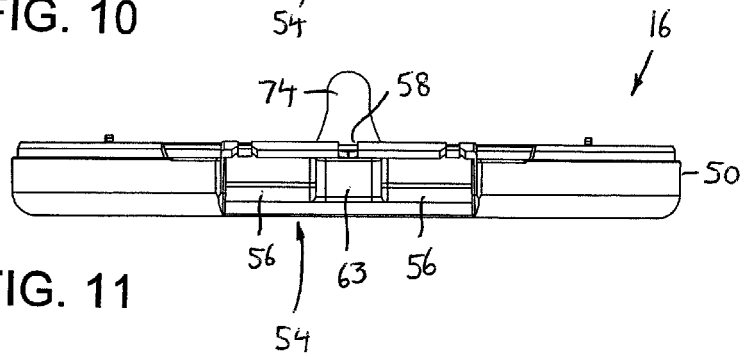
FIG. 11 is a rear elevational view of the upper ring frame.
Figure 12:
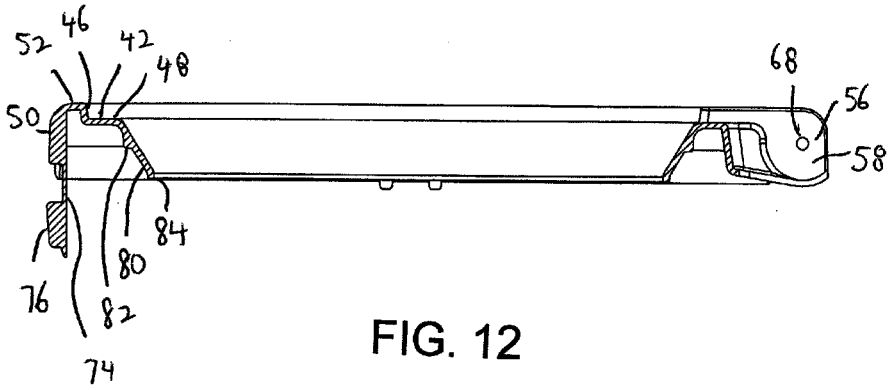
FIG. 12 is a cross-sectional view of the upper ring frame, taken along line 12-12 of FIG. 8.
Figure 17:
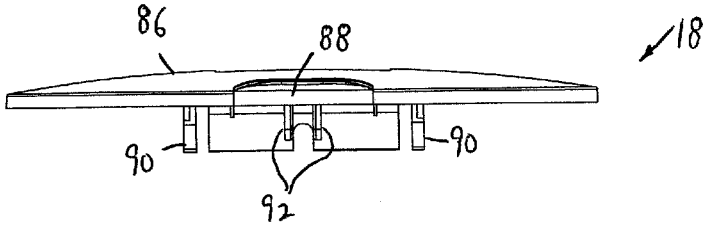
FIG. 17 is a front elevational view of the upper lid.
Figure 18:
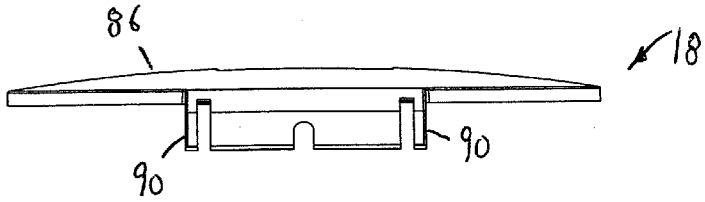
FIG. 18 is a rear elevational view of the upper lid.
Figure 13:
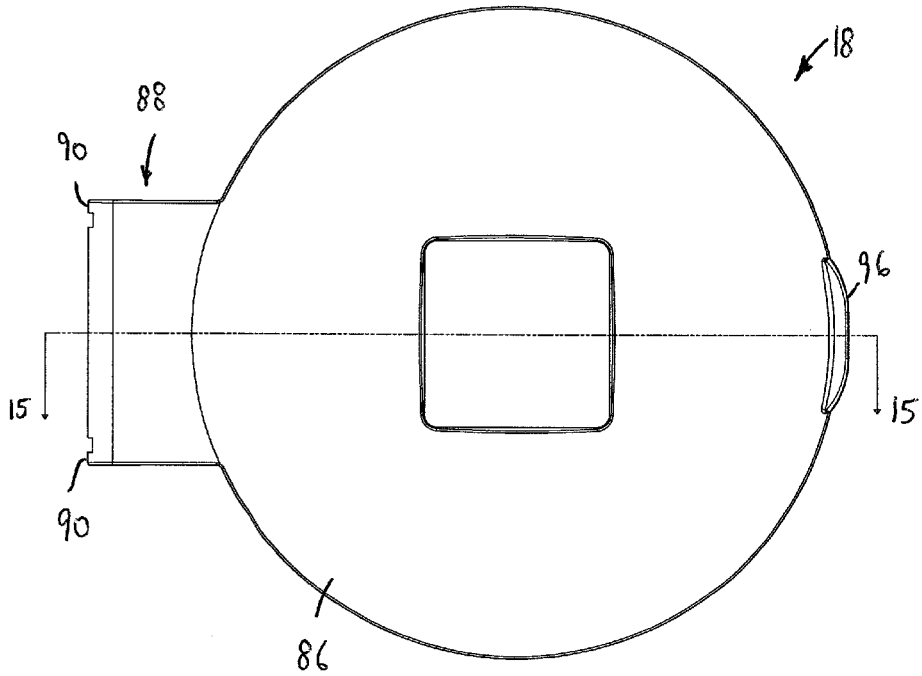
FIG. 13 is a top plan view of the upper lid.
Figure 14:
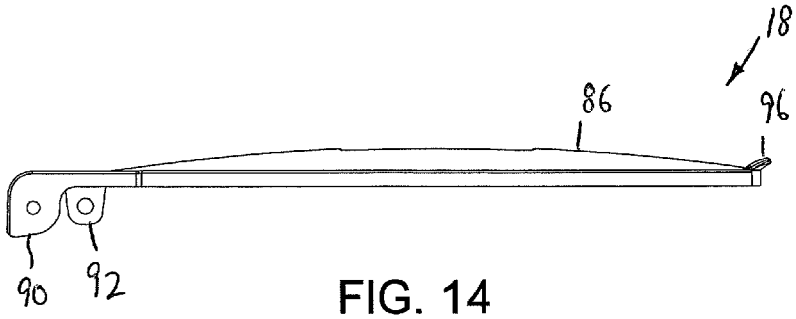
FIG. 14 is a right side elevational view of the upper lid.
Figure 15:
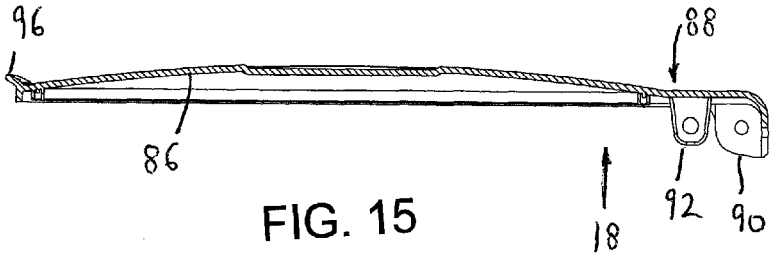
FIG. 15 is a cross-sectional view of the upper lid, taken along line 16-16 of FIG. 12.
Figure 16:
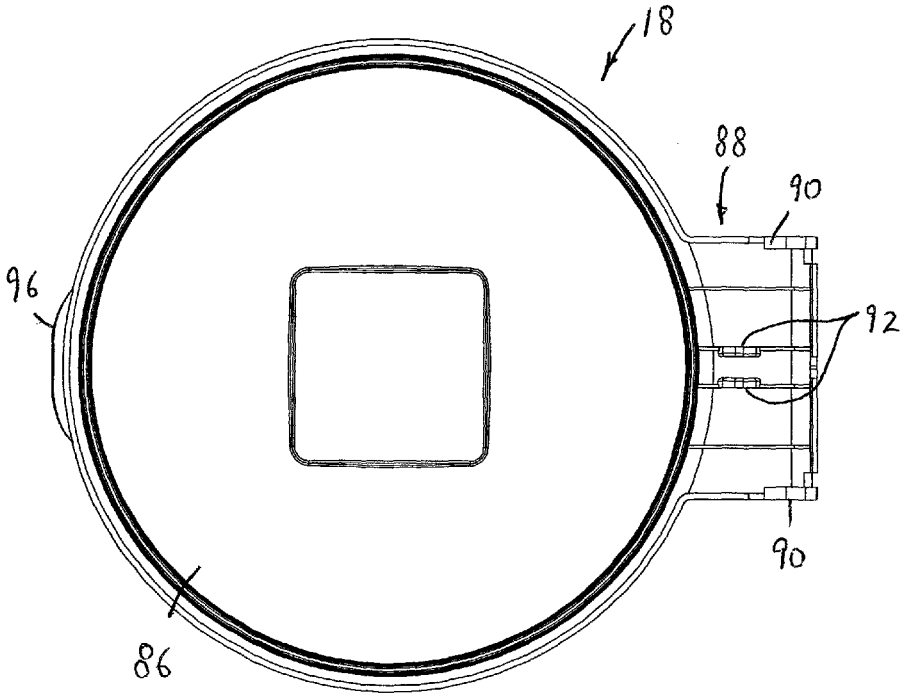
FIG. 16 is a bottom plan view of the upper lid.
Figure 19:
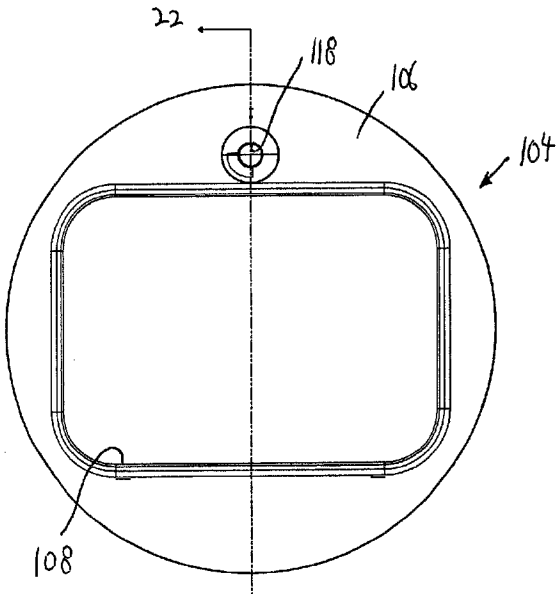
FIG. 19 is a top plan view of the wing support plate.
Figure 21:
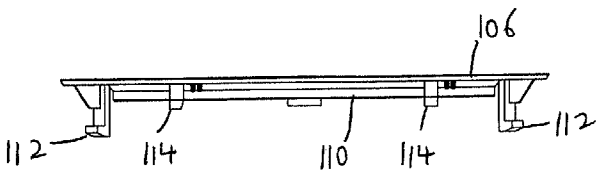
FIG. 21 is a front elevational view of the wing support plate.
Figure 20:
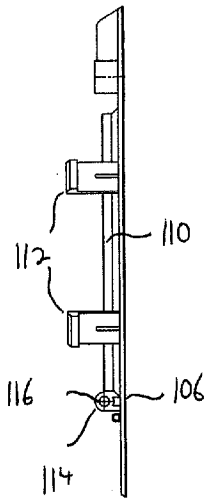
FIG. 20 is a left side elevational view of the wing support plate.
Figure 22:
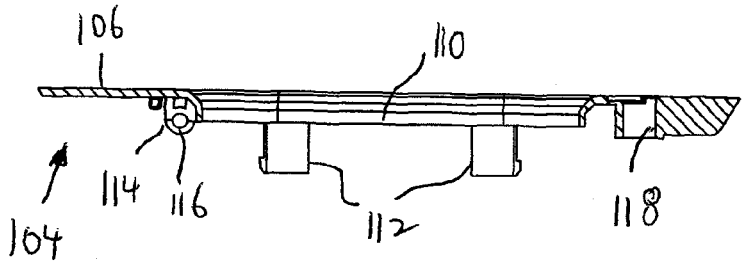
FIG. 22 is a cross-sectional view of the support plate of FIG. 19, taken along line 23-23 thereof.
Figure 23:
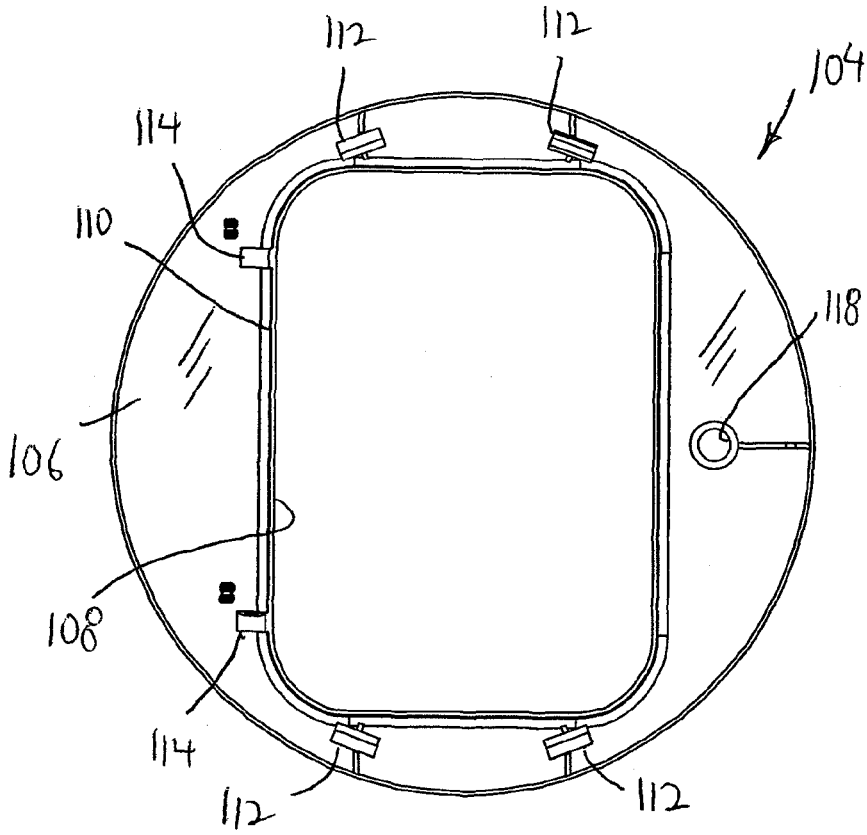
FIG. 23 is a bottom plan view of the wing support plate.

The rear portion of upper ring frame 16 includes a rearward extension section 54. Specifically, rearward extension section 54 includes two spaced apart bosses 56 connected with upper wall 42 and extending rearwardly thereof, with a gap 58 therebetween, and two extensions 60 extending rearwardly from upper wall 42 and positioned to the outside of bosses 56, with a gap 62 between each boss 56 and its respective extension 60, as best shown in FIG. 8. Annular lip 46, stub wall 52 and downwardly extending skirt 50 are also connected in a continuous manner to extensions 60, although as will be appreciated from the drawings, stub wall 52 has a greater radial dimension at extensions 60. In addition, guide walls 64 of the same height as lip 46 are formed between each end of substantially annular lip 46 and downwardly extending skirt 50 at rearward extension section 54, and are in facing relation to each other. As a result, a substantially rectangular shallow recess 66 is defined between guide walls 64 in rearward extension section 54 as an extension of shallow recess 48 and is in open communication therewith, as best shown in FIG. 8. A further recess 63 is formed in the upper wall of rearward extension section 54 on opposite sides of gap 58, the purpose for which will become apparent from the discussion hereafter.

Each boss 56 includes an axial opening 68 through which a pin 70 extends. Pin 70 also extends through openings (not shown) in two vertically oriented support walls 72 (FIG. 4) at the inner wall surface of outer enclosure 12 in order to pivotally mount upper ring frame 16 to the upper end of outer enclosure 12. In the closed position of upper ring frame 16, the lower edge of skirt 50 seats on the upper edge of outer enclosure 12.

In order to releasably lock upper ring frame 16 in this position, a spring finger 74 extends down from a front end of skirt 50 and includes an outwardly extending pushbutton 76 that is biased through an opening 78 at the front upper end of outer enclosure 12. In order to pivotally open upper ring frame 16 about pins 70, pushbutton 76 is pushed in against the force of spring finger 74, and upper ring frame 16 is pivoted to its open position.

Lastly, an annular tapered inner skirt 80 extends downwardly from the inner annular edge annular horizontal upper wall 42, with the underside of inner skirt 80 having an annular flat stop 82 at a substantial midpoint thereof. The inner annular edge of annular tapered inner skirt 80 defines a central opening 84 of upper ring frame 16.

Upper lid 18 is pivotally connected to upper ring frame 16. As best shown in FIGS. 13-18, lid 18 preferably has the same dimensions as shallow recesses 48 and 66. In this regard, lid 18 includes a planar or slightly convex, circular plate section 86 which seats on annular upper wall 42 within annular lip 46 and a rectangular plate section 88 connected to a rear end of circular plate section 86 and which seats on rearward extension section 54 within guide walls 64.

A first pair of ears 90 extends downwardly from the opposite sides of rectangular plate section 88 at a rear portion thereof so as to fit within gaps 62, with pins 70 also extending through openings in ears 90 to pivotally mount lid 18 to upper ring frame 16. A second pair of ears 92 extends inwardly and forwardly of ears 90 so as to be positioned within recess 63 on opposite sides of gap 58 when lid 18 is in covering relation to central circular opening 84. A pin 94 (FIG. 4) extends through openings in ears 92 and is accessible through gap 58. In this manner, as will be understood from the discussion hereafter, when pin 94 is biased upwardly, lid 18 is pivoted to an open position about pins 70. In addition, the front end of lid 18 includes an upwardly turned tab 96 which enables lid 18 to be manually opened by a person.

In order to bias lid 18 to an open position via a biasing force on pin 94, a plate 96 is pivotally mounted to base 14. Specifically, as shown best in FIGS. 4 and 5, plate 96 is pivotally balanced on a substantially centrally located pin 98 on base 14, with a front end of plate 96 which extends out of base 14 and within lower inwardly directed recessed portion 34, forming a foot pedal 100. A rod 102 (FIG. 4) has one end pivotally connected to the end of plate 96 which is opposite to foot pedal 100, and the opposite end of rod 102 is connected with pin 94. Thus, when a person steps down on foot pedal 100, plate 96 is pivoted about pin 98, thereby raising up the opposite rear end of plate 96, causing rod 102 to push pin 94 upwardly, thereby pivoting lid 18 about pins 70. When the person's foot is removed from foot pedal 100, lid 18 returns to its original closed position due to gravity and due to the force of rod 102 pulling pin 94 downwardly.

Figure 6:
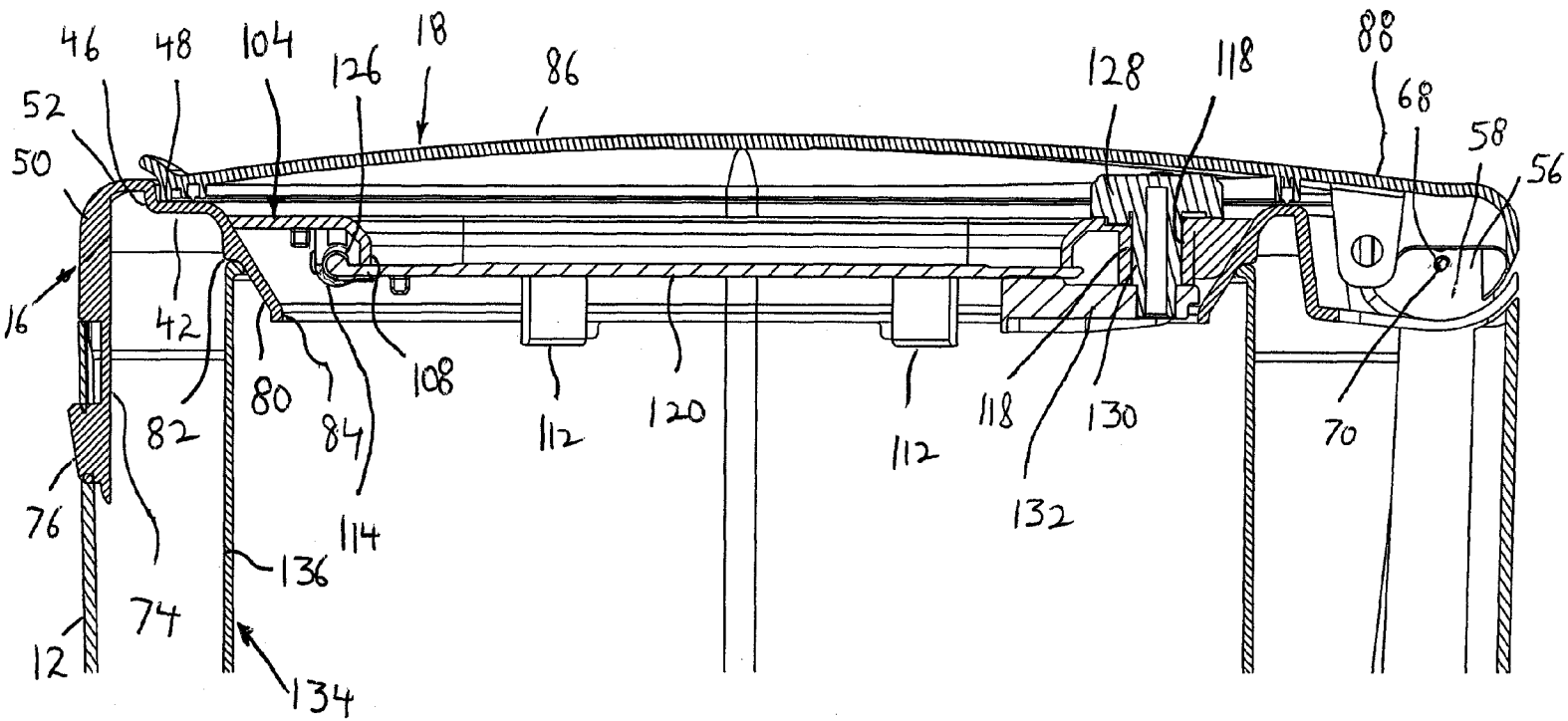
FIG. 6 is an enlarged vertical cross-sectional view taken along the same axis as FIG. 5, of the upper portion of refuse receptacle of FIG. 1.
Figure 7:
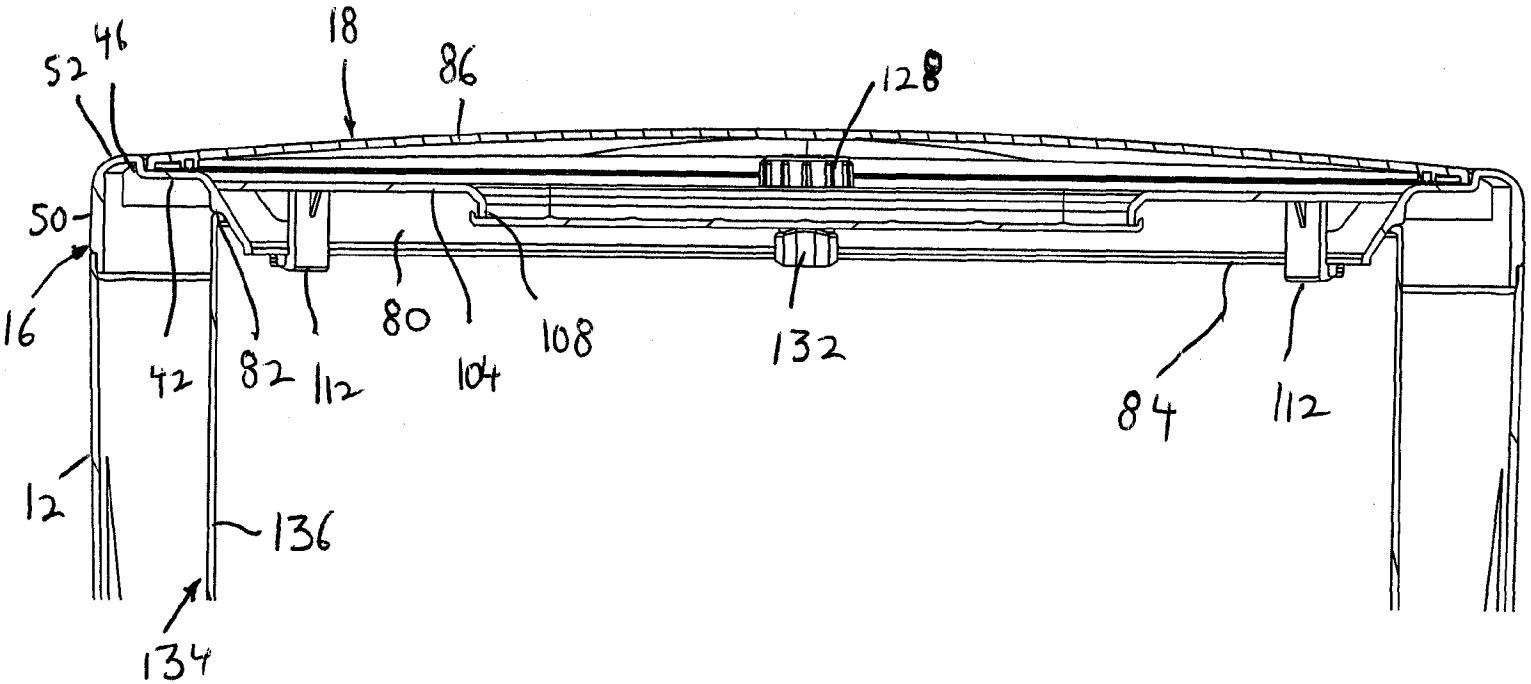
FIG. 7 is an enlarged vertical cross-sectional view similar to FIG. 6, but taken along an axis 90 degrees offset from that of FIG. 6.

In addition, a wing support plate 104 can be mounted on top of upper ring frame 16, as shown in FIGS. 6 and 7. As best shown in FIGS. 19-23, wing support plate 104 includes a circular plate 106 with a generally rectangular shaped central opening 108 defined by a slightly downturned inner peripheral wall 110. Four slightly flexible and resilient L-shaped hook arms 112 extend down from the underside of wing support plate 104 in surrounding relation to opening 108 and at the shorter sides of opening 108. When wing support plate 104 seats on tapered inner skirt 80 of upper frame member 16, as shown in FIGS. 6 and 7, hook arms 112 extend down through central opening 84 and snap onto tapered inner skirt 80 to releasably secure wing support plate 104 thereon. Wing support plate 104 also includes two ears 114 extending downwardly from the underside thereof at opposite ends adjacent one of the longer sides of opening 108, each ear 114 having a through bore 116 therein. A larger opening 118 is formed in wing support plate 104 adjacent the opposite longer side of opening 108.

Figure 24:
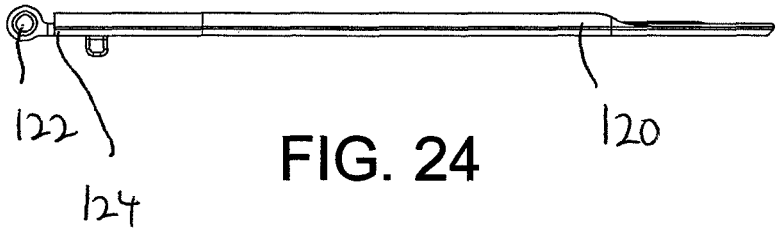
FIG. 24 is a side elevational view of the wing plate.
Figure 25:
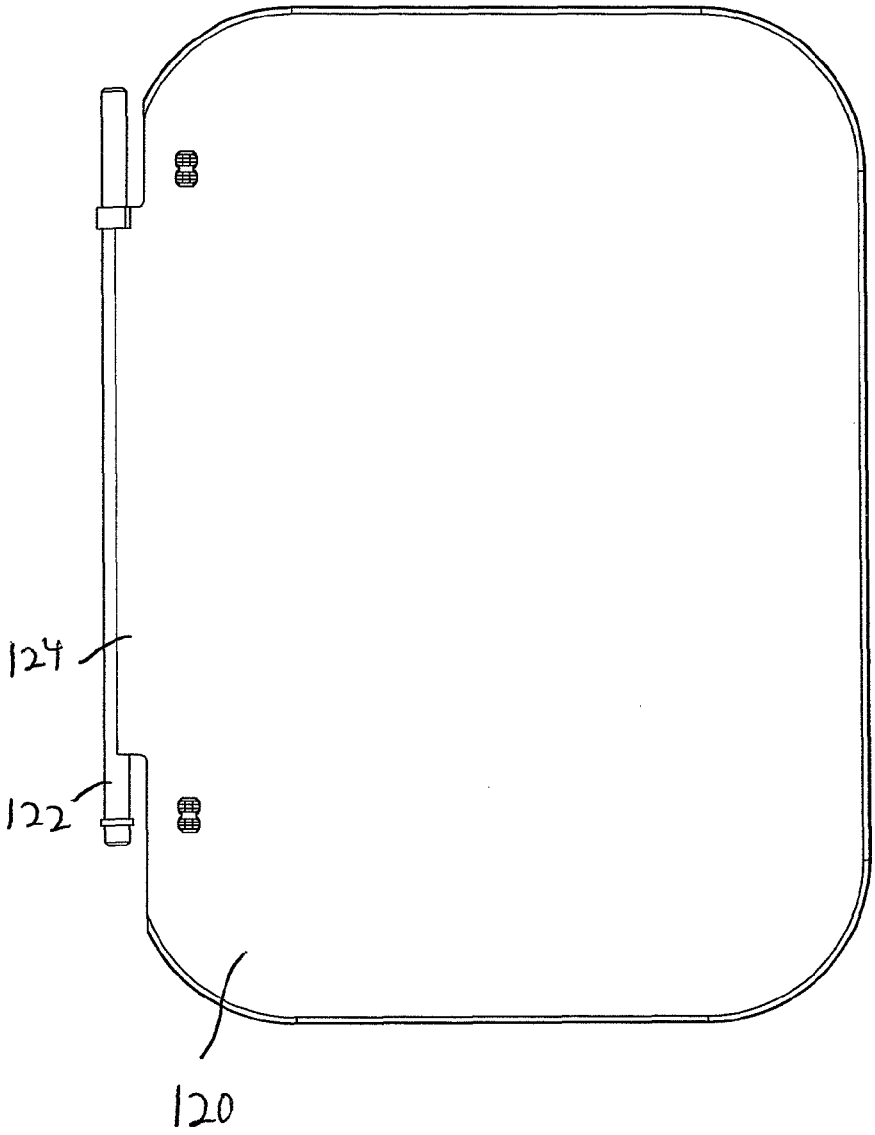
FIG. 25 is a top plan view of the wing plate.

As shown in FIG. 6, a wing plate 120 is pivotally secured to wing support plate 104. Specifically, as shown best in FIGS. 24 and 25, wing plate 120 has a generally rectangular configuration which is larger in dimension than central opening 108 so as to cover the same in use. A pivot rod 122 is connected by a flange section 124 at one longer edge of wing plate 120 and has its opposite ends rotatably mounted in through bores 116 of ears 114. At least one torsion or other spring 126 (FIG. 6) is connected between wing plate 120 and wing plate support 104 to normally bias wing plate 120 into contact with the lower edge of downturned inner peripheral wall 110 in covering relation to opening 108. In this manner, dirty diapers or other garbage are pushed through wing plate 120 to bias the same against the force of spring 126 and thereby place the refuse into the interior of refuse receptacle 10.

In order to releasably lock wing plate 120 in the closed position, for example, to prevent a toddler from throwing items into refuse receptacle 10, a turning knob 128 has its shaft 130 extending down through opening 118 of wing support plate 104, as shown in FIGS. 6 and 7, with a wing lock 132 fixed to the distal end of shaft 130. Thus, as shown in FIG. 6, turning knob 128 can be rotated such that wing lock 132 is positioned under the free end of wing plate 120 to prevent opening of the same. When turning knob 128 is rotated to move wing lock 132 away from wing plate 120, wing plate 120 can once again be rotated about its pivot rod 122.

A tubular refuse holder 134 is removably positioned within outer enclosure 12 and is supported by annular ledge 38. Tubular refuse holder 134 includes a cylindrical side wall 136 and an annular flange 140 which extends outwardly from the lower edge of side wall 136. As with U.S. Pat. No. 4,577,778, a continuous, elongated, vinyl sleeve 142 is mounted on tubular refuse holder 134 and preferably is folded several times on itself in fanfold manner to an appropriate length outwardly and inwardly by turns starting from one end thereof. Sleeve 142 therefore has a fanfolded upper end of several folded layers. The present invention, however, is not limited to this fanfold sleeve 142.

The folded vinyl sleeve 142 is mounted on the outer side wall 136 of tubular refuse holder 134 and has substantially the same length and outer diameter as the folded length and inner diameter of side wall 136, with one end of folded sleeve 142 being pulled downwardly through side wall 136 and being tied into a knot 144, as shown in FIGS. 2 and 3. In this regard, unused portions of sleeve 142 are supported by annular flange 140 and around side wall 136.

In use, refuse is inserted into sleeve 142 by pivoting wing plate 120 down. When the portion of the refuse collecting bag which is formed by knotted sleeve 142 and which extends downwardly within enclosure 12 is filled with refuse as shown in FIGS. 2 and 3, front door 22 is opened and the empty portion of sleeve 142 which is positioned upwardly of the refuse filled portion of sleeve 142 is grasped and cut on knife 32 provided on the inside of door 22. Then, the refuse filled portion is removed from enclosure 12, and the upper cut end of sleeve 142 is tied in a knot, removed and discarded. Sleeve 142 is then pulled down further and tied in a knot 144 to provide an empty bag and is ready for again collecting refuse.

However, a problem that results is that there is typically a gap between the upper end of side wall 136 of tubular refuse holder 134 and upper ring frame 116. As a result, odors from the refuse escape through this gap. Because refuse receptacle 10 is not airtight, these odors escape to the room in which refuse receptacle 10 is situated and/or are released when front door 22 is opened.

In accordance with the present invention, in order to substantially eliminate this problem, and as best shown in FIGS. 3-5 and 26-28, an annular spring plate 146 is mounted on annular ledge 38, with coil springs 148 interposed between annular ledge 38 and annular spring plate 146. Annular spring plate 146 has four circular bosses 150 equiangularly spaced along the lower surface thereof for receiving one end of each coil spring 148. Preferably, the upper surface of annular ledge 38 also has four circular bosses (not shown) to receive the opposite ends of coil spring 148. Annular flange 140 of tubular refuse holder 134 sits on top of annular spring plate 146. With this arrangement, coil springs 148 bias annular spring plate 146 upwardly such that the upper edge of side wall 136 of tubular refuse holder 134 engages with annular flat stop 82 at the underside of tapered inner skirt 80 of upper ring frame 16. In this manner, an annular seal is provided by this engagement to prevent odors from escaping at the upper edge of tubular refuse holder 134. It will be appreciated that the spring pressure from coil springs 148 is sufficiently strong that the weight of any refuse in pail 134 will not disengage upper edge of side wall 136 of tubular refuse holder 134 with annular flat stop 82 at the underside of tapered inner skirt 80 of upper ring frame 16.

In order to prevent inadvertent rotation of tubular refuse holder 134, the outer edge of spring plate 146 can be provided with cut-out sections 152, as shown in FIG. 4, which are guided by vertically oriented guide walls 40.

In addition to coil springs 148 biasing upper edge of side wall 136 of tubular refuse holder 134 with annular flat stop 82 at the underside of tapered inner skirt 80 of upper ring frame 16, coil springs 148 also serve a secondary purpose of raising up tubular refuse holder 134 to a higher level when upper ring frame 16 is pivoted to the open position of FIG. 3 when it is necessary to mount a new continuous, elongated, vinyl sleeve 142 on tubular refuse holder 134 in fanfold manner. In other words, coil springs 148 make it easier to remove tubular refuse holder 134 in order to mount a new vinyl sleeve 142 thereon.

It will be appreciated that, while the present invention has been discussed with wing support plate 104 and wing plate 120, which are particularly applicable when refuse receptacle 10 is used, for example, for disposal of used diapers or the like, the present invention is not limited thereby. For example, refuse receptacle can be used for other refuse, such as beneath a paper shredder, for receiving shredded paper. In such case, wing support plate 104 and wing plate 120 would be eliminated. Further, it will be appreciated that, in such case, the biasing up by coil springs 148 of tubular refuse holder 134 into contact with upper ring frame 16 to remove the gap therebetween serves the further purpose that shredded paper will not exit through any gap therebetween to the outside of tubular refuse holder 134.

It will be appreciated that, while the present invention has been discussed in relation to a refuse receptacle of the type having a continuous fanfold sleeve 142, the present invention is not limited thereby.

Further, while tubular refuse holder 134 has been shown to be biased against upper frame member 16, it would be possible to provide, instead of, or in addition to, a modified portion of upper frame member 16 biased against the upper edge of tubular refuse holder 134. In other words, it is only important that there be relative biasing movement between the upper frame member 16 and the upper edge of the tubular refuse holder 134 in order to provide a seal thereat.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A refuse receptacle comprising:

an outer enclosure having an upper frame member with an opening through which refuse can be deposited into the outer enclosure, a cover movably mounted on the upper frame member between a position normally closing said opening and a position which permits refuse to be deposited through said opening into the outer enclosure, a refuse holder mounted in the outer enclosure, the refuse holder including an upper open end for receiving refuse deposited through said opening, and said refuse holder has a tubular shape and is arranged to hold a disposable bag in such a manner that said disposable bag extends down through said refuse holder to a position below said refuse holder, wherein said outer enclosure includes an inner wall having a central opening through which said disposable bag is adapted to extend down to a position below said refuse holder, and at least one biasing member supported on said inner wall and interposed between said inner wall and said refuse holder to provide relative biasing movement between the refuse holder and upper frame member such that there is engagement of the upper open end of the refuse holder against the upper frame member to provide a seal thereat.

2. A refuse receptacle according to claim 1, wherein said at least one biasing member includes at least one spring which biases the refuse holder toward the upper frame member.

3. A refuse receptacle according to claim 2, further comprising a spring plate for engaging an opposite end of said at least one spring, with said refuse holder mounted on said spring plate.

4. A refuse receptacle according to claim 2, wherein there are a plurality of said springs.

5. A refuse receptacle according to claim 2, wherein each said spring is a coil spring.

6. A refuse receptacle according to claim 1, further comprising an arrangement for releasably engaging said upper frame member to the outer enclosure.

7. A refuse receptacle according to claim 1, wherein the upper frame member is pivotally mounted at one end thereof to the outer enclosure and includes a releasable locking arrangement at an opposite end for releasably engaging said outer enclosure.

8. A refuse receptacle according to claim 7, wherein said refuse holder is removably mounted in said outer enclosure, and can be removed from the outer enclosure when said opposite end of the upper frame member is disengaged from the outer enclosure and the upper frame member is pivoted away from the outer enclosure.

9. A refuse receptacle according to claim 1, wherein said refuse holder is adapted to hold a continuous sleeve thereon which is folded over itself many times to provide many folds and which is pulled down through an opening in a bottom of the tubular refuse holder such that a knot is adapted to be tied therein to form said disposable bag.

10. A refuse receptacle according to claim 9, wherein said outer enclosure further includes a front door through which said continuous sleeve can be cut and removed when filled with refuse.

11. A refuse receptacle comprising:

an outer enclosure having an upper frame member with an opening through which refuse can be deposited into the outer enclosure, a cover movably mounted on the upper frame member between a position normally closing said opening and a position which permits refuse to be deposited through said opening into the outer enclosure, a refuse holder mounted in the outer enclosure, the refuse holder including an upper open end for receiving refuse deposited through said opening, and at least one biasing member which provides relative biasing movement between the refuse holder and upper frame member such that there is engagement of the upper open end of the refuse holder against the upper frame member to provide a seal thereat, wherein said at least one biasing member includes at least one spring which biases the refuse holder toward the upper frame member, and wherein said outer enclosure includes at least one guide on an inner wall thereof for guiding movement of the refuse holder toward the upper frame member without rotation of the refuse holder.

12. A refuse receptacle according to claim 11, wherein said outer enclosure includes an inner wall for supporting one end of said at least one spring, further comprising a spring plate for engaging an opposite end of said at least one spring, with said refuse holder mounted on said spring plate, and said spring plate includes at least one cut-out section for receiving said at least one guide on the inner wall of said outer enclosure.

13. A refuse receptacle comprising:

an outer enclosure having an upper frame member with an opening through which refuse can be deposited into the outer enclosure, a cover movably mounted on the upper frame member between a position normally closing said opening and a position which permits refuse to be deposited through said opening into the outer enclosure, a refuse holder mounted in the outer enclosure, the refuse holder including an upper open end for receiving refuse deposited through said opening, and at least one biasing member which provides relative biasing movement between the refuse holder and upper frame member such that there is engagement of the upper open end of the refuse holder against the upper frame member to provide a seal thereat, said at least one biasing member including at least one spring which biases the refuse holder toward the upper frame member, wherein said outer enclosure includes an inner wall for supporting one end of said at least one spring, a spring plate for engaging an opposite end of said at least one spring, with said refuse holder mounted on said spring plate, and wherein said refuse holder has a tubular shape and a flange which extends outwardly from a lower edge of said tubular refuse holder, with said flange seating on said spring plate.

* * * * *